United States Patent [19]

Malterer

[11] 4,191,263

[45] Mar. 4, 1980

[54] PEAT SAMPLING PROBE

[75] Inventor: Thomas J. Malterer, Hibbing, Minn.

[73] Assignee: State of Minnesota as represented by the Commissioner of Natural Resources, St. Paul, Minn.

[21] Appl. No.: 928,233

[22] Filed: Jul. 26, 1978

[51] Int. Cl.[2] ..... E21C 11/02

[52] U.S. Cl. ..... 173/28; 173/91; 173/147; 254/148

[58] Field of Search ..... 173/28, 91, 140, 147, 173/152, 160; 175/162; 254/148

[56] References Cited

U.S. PATENT DOCUMENTS

| | | | |
|---|---|---|---|
| 2,661,189 | 12/1953 | Gillerstrom | 173/147 X |
| 2,848,196 | 8/1958 | Simmonds | 173/147 X |
| 3,009,521 | 11/1961 | Failing | 173/147 X |
| 3,354,660 | 11/1967 | Vaughan . | |
| 3,559,415 | 2/1971 | Vaughan et al. | |
| 3,613,804 | 10/1971 | Jonsson | 173/147 X |
| 3,692,123 | 9/1972 | Gyongyosi | 173/147 |
| 3,739,865 | 6/1973 | Wolda | 175/244 |

FOREIGN PATENT DOCUMENTS

| | | | |
|---|---|---|---|
| 84336 | 2/1869 | France | 173/28 |

*Primary Examiner*—Lawrence J. Staab

*Attorney, Agent, or Firm*—Orrin M. Haugen; Thomas J. Nikolai

[57] ABSTRACT

Sample gathering apparatus for drivably moving a core sampling assembly into and out of subterranean zones for gathering core samples therewithin, with the apparatus including an elongated frame means which is adapted for adjustable pivotal mounting upon a supporting vehicle. Drive means are provided for delivering power to the core sampling assembly, and coupling means are further provided for releasably securing the drive means to the core sampling assembly. The core sampling assembly is arranged to be driven vertically into the subterranean zones to be sampled, and the coupling means which releasably secures the drive means to the core sampling assembly permits pivotal motion of the core sampling assembly about a generally horizontal axis so as to permit pivotal lifting of the core sampling assembly from the ground surface for easy removal of the sample retained therewithin.

4 Claims, 8 Drawing Figures

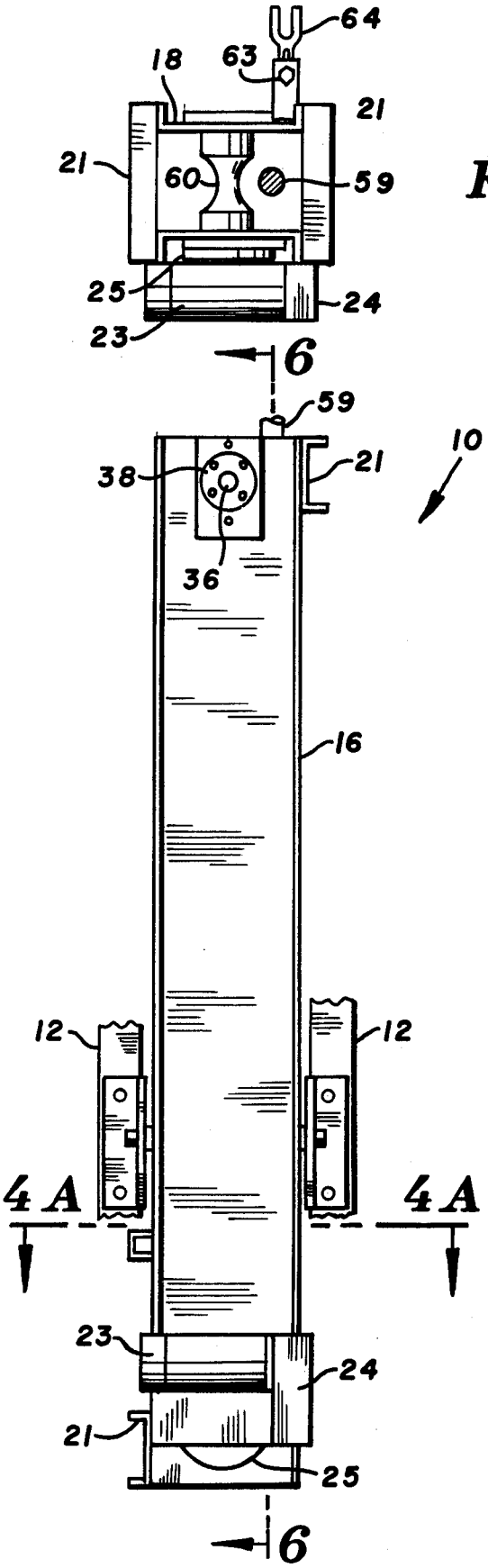
FIG. 4A
FIG. 4
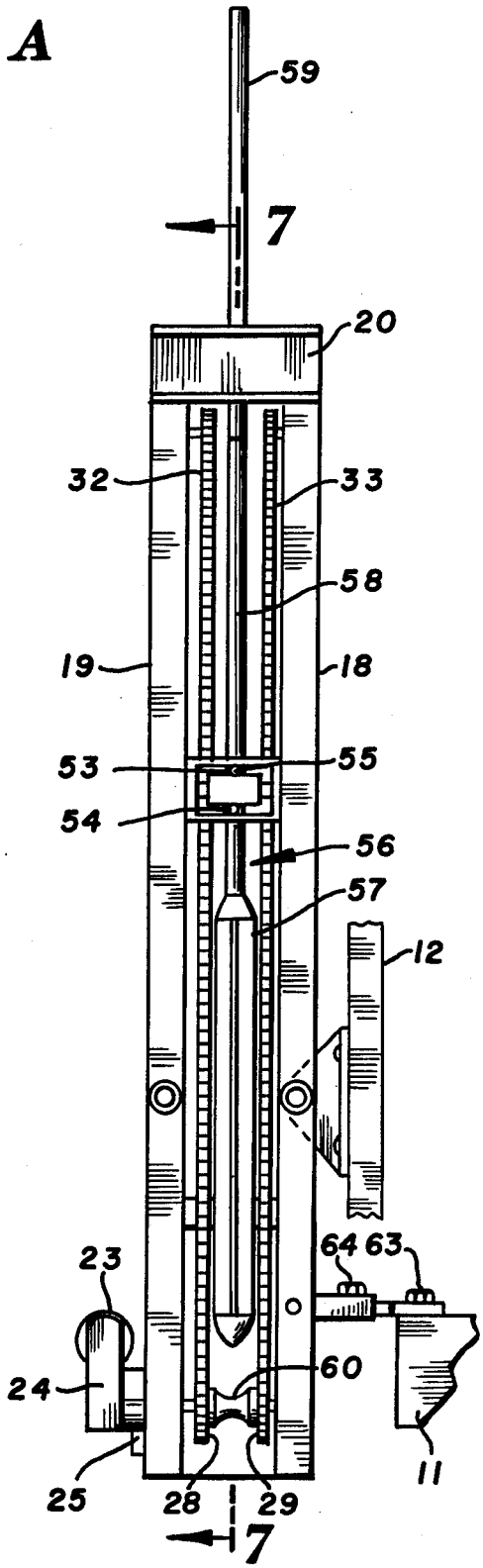
FIG. 5

PEAT SAMPLING PROBE

BACKGROUND OF THE INVENTION

The present invention relates generally to a sample gathering apparatus, and more particularly to an apparatus for drivably moving a core sampling assembly into and out of subterranean zones for the gathering of core samples. The apparatus of the present invention is particularly adapted for use in the gathering of peat samples from peatlands.

Peat has become regarded as a more valuable resource in recent times. It is an organic residue originating under more or less water-saturated conditions in the earth's crust, with the material being formed generally through incomplete decomposition of plant and animal constituents. The incomplete decomposition of the plant and animal constituents occurs because of anaerobic conditions in the presence of low temperatures, and possibly from other complex causes. The origin of peat is defined in a work by M. L. Heinselman, "Forest Sites, Bog Processes and Peatland Types in the Glacial Lake Agassiz Region". Peat is, at the present time, recognized as a multi-use resource which includes use of this material as a source of energy, as well as for use in the garden market to improve the conditions of the soil.

In order to determine the nature and quality of the peatland, core samples are gathered so as to conduct determinations upon the sample such as determining water content, pH, bulk density, BTU values, percent of volatiles present, fixed carbon content, ash content, total sulfur content, as well as heavy metal content. Certain types of peat, particularly those found in areas within and adjacent the State of Minnesota have been found to be best for energy output, and as such, may have significant value in the conversion of the peat into synthetic natural gas.

Because of the nature of the areas in which peat occurs, it is frequently difficult to move heavy equipment into the peatland or peat bog area. All-terrain vehicles are able to traverse the surface of peat bog areas, and when these vehicles are not heavily loaded, they will normally ride along the surface of the bog. The apparatus of the present invention is of sufficiently lightweight so as to permit mounting upon all-terrain vehicles, hence making it possible to quickly and efficiently gather core samples to determine the value of the peat contained within the immediate peatland area. In addition to its lightweight, the apparatus is designed so as to permit vertical stroke movement of substantial depth, with the apparatus including generally an assembly to which additional lengths of rod may be added to extend the depth of the probe.

While a number of core sampling receptacles are available and in use today, one such device which has been found to be of particular use in the sampling of peat is known as the "Macaulay" type. The Macaulay type core sampling receptacle is generally an elongated tubular structure containing a stabilizing fin which will permit the device to be forced downwardly into the peatland, and thereafter articulated so as to close a semicircular cylindrical wall about a zone of undisturbed peat. Other types of core sampling receptacles may be employed if desired, such as the Shelby type device. In order to achieve the articulation necessary for the semicircular cylindrical segment, means are appropriately provided in the drive mechanism to permit arcuate rotation to occur.

SUMMARY OF THE INVENTION

Briefly, in accordance with the present invention, a sample gathering apparatus is provided which includes an elongated frame means along with drive means mounted thereupon for moving the core sampling assembly into and out of subterranean zones. Coupling means are provided for releasably securing the drive means to the core sampling assembly. The frame means is provided with a first pivotal joint for adjustably mounting the sample gathering apparatus upon a vehicle, such as a self-propelled all-terrain vehicle. The coupling means which secures the drive means to the core sampling assembly is pivotally secured to an endless belt drive arrangement and is arranged to permit pivotal motion of the core sampling assembly about a generally horizontal axis. The frame means and the first pivotal joint are provided in order to permit the core sampling assembly to be properly aligned and arranged in plumb disposition prior to the time that the core sampling assembly enters the earth.

Therefore, it is a primary object of the present invention to provide an improved core sampling apparatus which is designed for mounting upon a self-propelled vehicle, and which is designed to permit vertical movement of the core sampling assembly into the earth, and pivotal movement of the core sampling assembly about a horizontal axis when removed from the earth.

It is a further object of the present invention to provide an improved sample gathering apparatus, specifically a core sampling apparatus which is arranged to drivably move a core sampling assembly into and out of subterranean zones for gathering core samples therewithin, the arrangement including motor means for drivably moving the core sampling assembly into the earth, and further providing for means to expeditiously remove the core sample from the sampling receptacle upon removal from the earth.

Other and further objects of the present invention will become apparent to those skilled in the art upon a study of the following specification, appended claims, and accompanying drawings.

IN THE DRAWINGS

FIG. 4 is a side elevational view, on a slightly enlarged scale, of the sample gathering apparatus, and illustrating the manner in which the motor is mounted upon and secured to the frame;

FIG. 4A is a horizontal sectional view taken along the line and in the direction of the arrows 4A—4A of FIG. 4;

FIG. 5 is a rear elevational view of the sample gathering apparatus of the present invention, and being drawn to the same scale as FIG. 4, and illustrating the manner in which the drive means is mounted within the frame means;

DESCRIPTION OF THE PREFERRED EMBODIMENT

Figure 1:
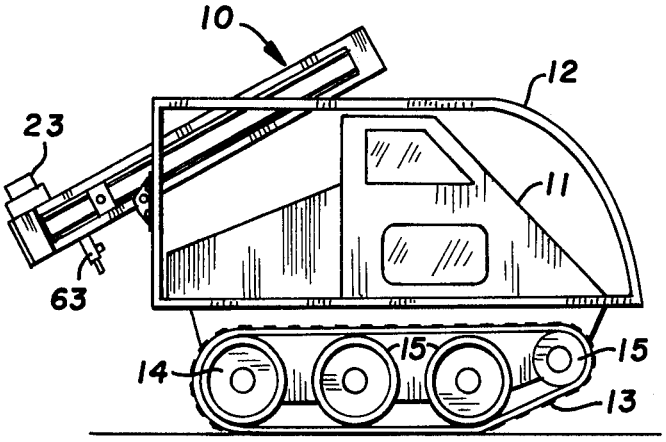
FIG. 1 is a side elevational view of the sample gathering apparatus of the present invention, with the apparatus being mounted upon a self-propelled all-terrain vehicle, and being disposed in transport disposition.
Figure 2:
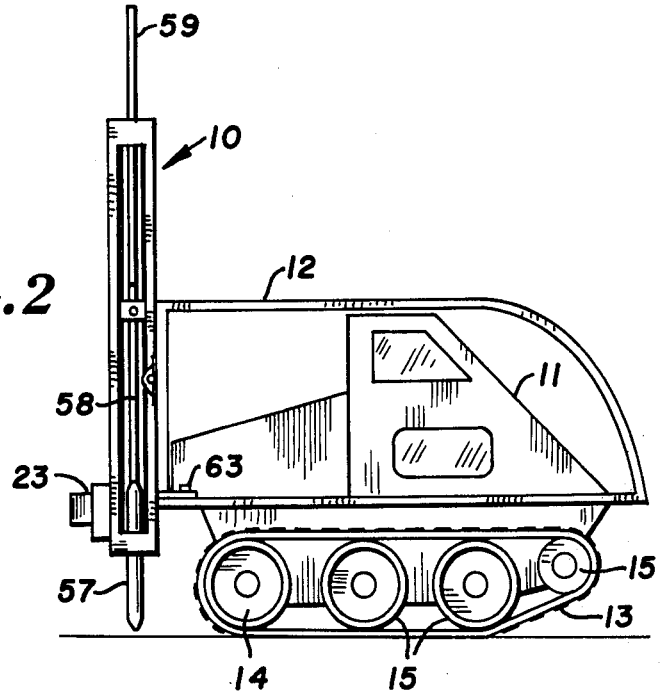
FIG. 2 is a view similar to FIG. 1, wherein the sample gathering apparatus is arranged in core sampling disposition.
Figure 3:
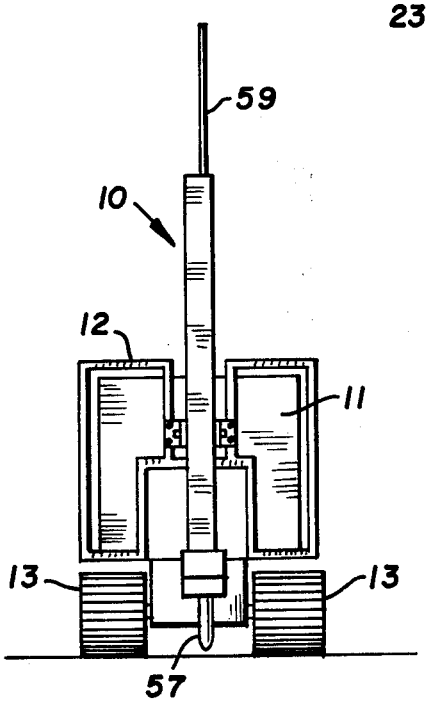
FIG. 3 is a rear elevational view of the sample gathering apparatus, and illustrating the structure in the same disposition as is illustrated in FIG. 2.

In accordance with the preferred embodiment of the present invention, and with particular attention being directed to FIGS. 1-3 of the drawings, the sample gathering apparatus generally designated 10 is shown as being mounted upon a self-propelled all-terrain vehicle 11, with the vehicle being provided with structural frame members 12—12 to which the sample gathering apparatus 10 is secured. As is typical of self-propelled all-terrain vehicles, the vehicle is provided with an engine (not shown) which drives endless tracks 13—13 by means of drive sprocket 14 and a number of idler sprockets 15—15. Self-propelled all-terrain vehicles are readily commercially available.

As has been indicated, self-propelled all-terrain vehicles are particularly adapted for use in peatland areas, since they are generally of sufficiently lightweight so as to be supported by the surface, and thus render it possible for the users to drive into and around the peatland area including bogs.

With attention now being directed to FIGS. 4, 4A, and 5 of the drawings, the sample gathering apparatus generally designated 10 includes frame means 16 which, for the most part, includes a pair of side channels 18 and 19, and upper and lower end plates 20 and 21 respectively. As is apparent in the drawings, the lower plate 21 is arranged in oppositely disposed position from upper plate 20, this disposition being desirable and required in order to permit pivotal motion of the core sampling assembly about a horizontal axis, as will be more fully explained hereinafter.

Drive means are provided, and mounted upon the frame 16, with the drive means including a motor 23 which is drivably coupled to gear box 24, with gear box 24 being, in turn, drivably coupled to clutch unit 25. The motor 23 is preferably a commercially available winch motor, these winch motors normally being provided with winch gear boxes. It is appreciated that these devices and structures are widely available commercially and need no further explanation here since they are well known and recognized to those skilled in the art. The clutch assembly shown at 25 is designed to deliver the proper and desired amount of torque to the drive system, with the torque setting of the clutch being adjusted to provide a drive force to the core sampling assembly which is just sufficient to provide modest lifting of the rear portion of the self-propelled all-terrain vehicle 11.

Clutch 25 is coupled directly to drive shaft 27, with drive sprockets 28 and 29 being fast upon shaft 27. Shaft 27, as shown, is journaled in bearing assemblies such as at 30, with a corresponding and mating bearing assembly being provided at the opposed end of shaft 27, but being concealed in the view of FIG. 6. Sprockets 28 and 29 are in mesh with endless belts 32 and 33, with the term "endless belt" being used in a comprehensive sense, since elements 32 and 33 are actually endless drive chains. Chains 32 and 33 are, in turn, trained over idler sprockets 34 and 35, with these idler sprockets being fast on shafts 36 and 37 respectively. Shafts 36 and 37 are stub shafts which are, in turn, journaled for rotation within bearing blocks 38 and 39. The reason stub shafts are used is to permit swingable pivotal motion of the core sampling assembly about a horizontal axis, and furthermore, the use of stub shafts in this area minimizes the size and hence the weight of the overall structure.

Figure 6:
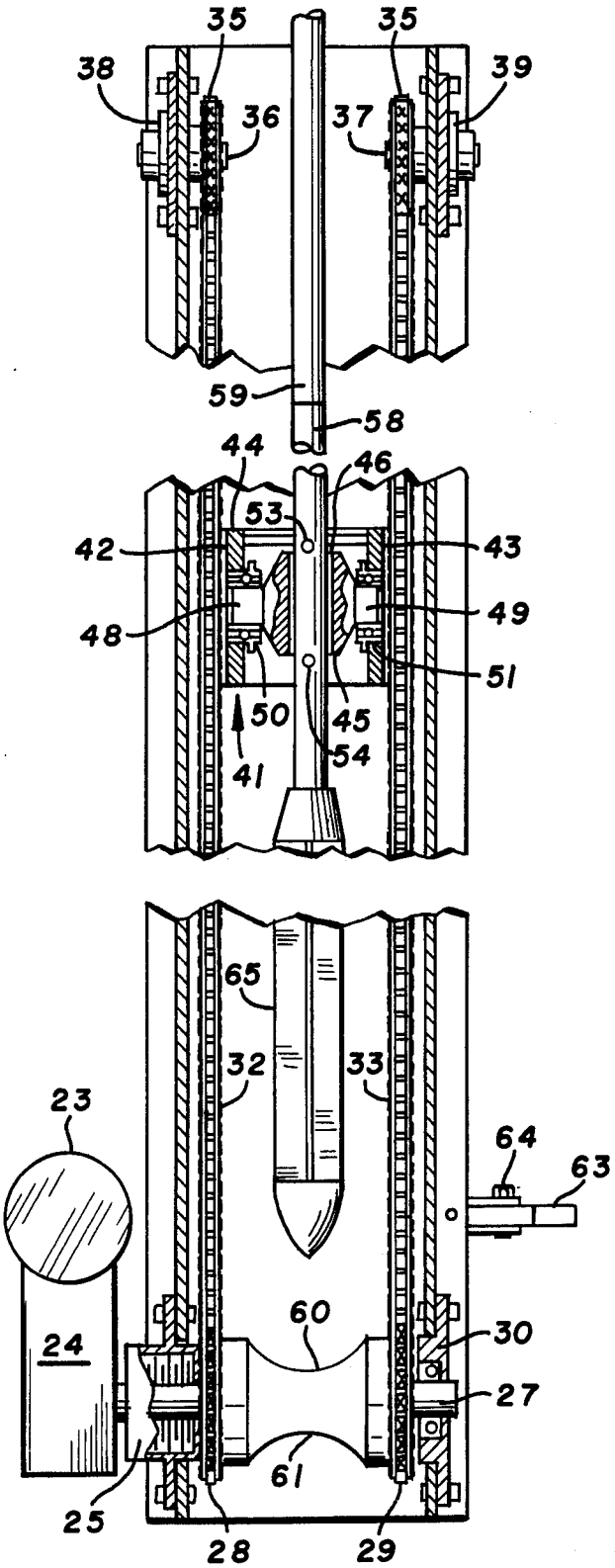
FIG. 6 is a vertical sectional view taken along the line and in the direction of the arrows 6—6 of FIG. 4, with FIG. 6 being illustrated on a slightly enlarged scale.
Figure 7:
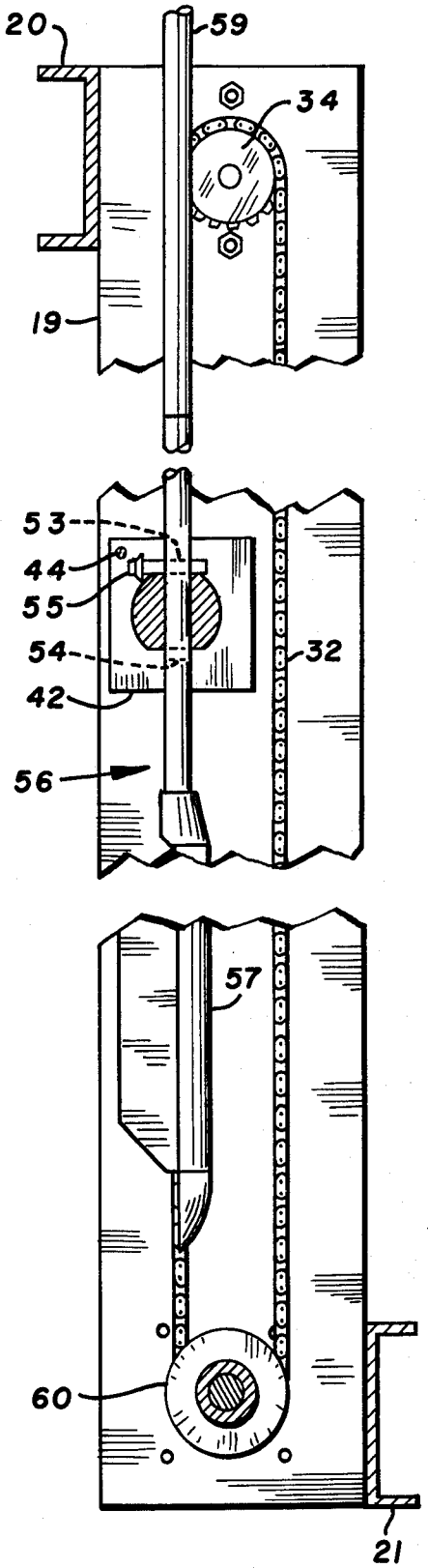
FIG. 7 is a vertical sectional view taken along the line and in the direction of the arrows 7—7 of FIG. 5, with FIG. 7 being likewise shown on a slightly enlarged scale.

With attention continuing to be directed to FIGS. 6 and 7, a drive assembly is shown generally at 41, with the assembly including a pair of side plates 42 and 43 which are secured together by suitable means, such as tie rod 44. Between side panels 42 and 43, there is positioned a core sample assembly receiving hub 45. A bore is formed centrally of receiving hub 45, as at 46, with this bore being designed to receive a portion of the core sample assembly therewithin, as will be more fully described hereinafter. Receiving hub 45 is provided with a pair of side trunnions 48 and 49, the trunnions being received within bearings 50 and 51, and hence arranged for journaled rotation therewithin. As is indicated in FIG. 7, a pair of spaced apart bores are formed within hub 45 as at 53 and 54, with the bores 53 and 54 being arranged to receive pin means such as pin 55 for coupling receiving hub 45 to an extension member of the core sampling assembly as will be described more fully hereinafter. Specifically, the core sampling assembly which is shown generally at 56 includes a Macaulay type sampling head 57 to which is secured an adaptor segment 58 and one or more extension segments 59. The sampling head 57 along with adaptor 58 and extensions 59 make up what is defined as the core sampling receptacle assembly. Pin 55 is arranged to engage adaptor 58 coaxially, so as to assure positive and plumb driving. Adaptor 58 and extensions 59 are each provided with spaced apart transverse bores, with these bores being arranged to receive pins such as pin 55 therethrough. While being driven downwardly into the earth, it has been found desirable to provide pin 55 engaged in the lower bore, such as bore 54, while during withdrawal, it is preferable to have the pin such as pin 55 in the upper bore. The disposition in the upper bore is illustrated in FIG. 7. The reason for the dual disposition is due to the fact that the pin has been found to be more readily released from the coupling disposition during a driving sequence when it is disposed in the bottom bore, and in turn, more readily released from the top bore during withdrawal.

Attention is now re-directed to FIGS. 4A and 6 of the drawings wherein the details of hub 60 are shown. Specifically, hub 60 is in the form of a spool having a hollow core therewithin, and with the hollow core receiving shaft 27 so as to render hub 60 freely rotatable thereon. Hub 60 is in the form of a cradle, and is designed to assist in initial guiding of the sampler head 57 as it is first driven into the surface of the earth. As can be appreciated, hub or cradle 60 is designed and positioned so as to provide a guiding arcuate surface as at 61 which is useful in assuring that the core sampling assembly is plumb when it enters the earth's surface.

In a typical sampling operation, the operator arrives at the sampling site and levels the apparatus from side-to-side. The frame means is erected and is adjustably positioned so as to be arranged vertically and plumb. For assisting in this leveling operation, an adjustable bifurcated clamp is provided as at 63, into which there is fitted the bracket and clamping bolt assembly 64, as is illustrated in FIGS. 4A and 5. Thereafter, sampler head 57 and adaptor 58 are secured to hub 45, and, normally, a first length of extension 59 is secured to the end of adaptor 58. Normally, conventional drill rod is employed for each extension rod such as extension 59, with drill rod being available commercially and in desired lengths. For most core sampling operations, core samples of one meter in length are obtained on each sampling operation, and hence a graduated scale of one meter or multiples thereof are normally desired for lengths of extension rods such as extension rod 59. As has been indicated, the locking pin such as pin 55 is secured in hub 45 and through core sampling assembly (adaptor 58) in the lower bore 54. The operator then determines that the core sampling assembly is in level and plumb disposition, and further checks the disposition of the sampler 57 relative to the surfaces of hub cradle 60.

The operation is then commenced with the winch motor 23 being activated to deliver power to endless belts or chains 32 and 33, and thus drive sampler 57 and the remaining portions of the core sampling assembly downwardly. As indicated, the downward distance is one meter, and when this depth has been achieved, the sampler is articulated so as to capture the sample desired. In a Macaulay type sampler, the external sheath such as is illustrated at 65 is rotated arcuately 180°, thereby capturing the sample disposed at that location. Thereafter, pin 55 is removed, and placed in the upper bore of hub 45, at which time the core sampling assembly is removed from the earth. Upon being fully removed or extracted from the sample bore, the operator tilts sampler 57 upwardly about the axis formed by trunnions 48 and 49, and thus is able to remove the sample at a convenient location, and with the sampler head being arranged in horizontal disposition. The horizontal disposition for the sampler head is important in order to preserve all of the entrained water, thus rendering it possible to achieve a more accurate analysis of the sample obtained. Upon removal of the sample from the head 57, the pin 55 is returned to the lower position, that is within bore 54, and the operation is re-started.

As has been indicated, the operation of the device is simple and straightforward, and provides a desired mechanism for gathering samples of undisturbed earth, and specifically undisturbed peat. The apparatus of the present invention is fully capable of use to core sample depths of 50 feet or more, with such a depth of deposit being occasionally found in North America.

I claim:

1. Sample gathering apparatus for drivably moving a core sampling assembly into and out of subterranean zones for gathering a core sample therewithin, and being arranged for mounting upon a vehicle, said sample gathering apparatus comprising:

(a) frame means, drive means mounted upon said frame means for moving said core sampling assembly into and out of subterranean zones, and coupling means for releasably securing said drive means to said core sampling assembly;

(b) said frame means being elongated and including:

(1) a first pivotal joint for adjustably mounting said sampling apparatus upon a vehicle; and (2) means for mounting said drive means upon said frame and for delivering power to said coupling means;

(c) said drive means including:

(1) motor means for delivering power to said coupling means;

(2) an elongated endless belt mounted for movement along a first drive plane and being driven by said motor means and having said coupling means secured thereto and arranged for motion therewith, said coupling means including a core sample assembly retainer;

(3) said core sample assembly retainer including a receiving hub pivotally secured to said endless belt and arranged for pivotal motion about a swing axis generally transverse to said drive plane, with said hub having means for releasably securing said core sampling assembly thereto;

(d) said frame means further having upper and lower segments with the lower segment being formed with an open front surface so as to permit said core sampling assembly to swing pivotally outwardly of said frame means about said swing axis for pivotal lifting of said core sampling assembly from the ground surface and about said swing axis; and (e) said receiving hub and said core sampling assembly being coaxially disposed, and wherein the coupling between said hub and core sampling assembly is a pin means, with a pair of bores being formed within said core sampling means, and with each bore being disposed generally along the axis of said core sampling means, with one of said bores being disposed above said swing axis and with the other being disposed below said swing axis.

2. The sample gathering apparatus as defined in claim 1 being particularly characterized in that said drive means includes a clutch means interposed between said motor means and said elongated endless belt.

3. The sample gathering apparatus as defined in claim 1 being particularly characterized in that a guide cradle is mounted in said frame means for controlled positioning of said core sampling assembly within said frame means.

4. The sample gathering apparatus as defined in claim 3 being particularly characterized in that said guide cradle is a member having a generally arcuate guiding surface and being disposed along said lower frame segment and with said core sampling assembly being normally positioned between said arcuate guiding surface and the said open front surface of said lower frame segment.

* * * * *